US010968919B2

(12) United States Patent
Sishtla

(10) Patent No.: US 10,968,919 B2
(45) Date of Patent: Apr. 6, 2021

(54) TWO-STAGE CENTRIFUGAL COMPRESSOR

(71) Applicant: Carrier Corporation, Palm Beach Gardens, FL (US)

(72) Inventor: Vishnu M. Sishtla, Manlius, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 4 days.

(21) Appl. No.: 16/461,985

(22) PCT Filed: Nov. 9, 2017

(86) PCT No.: PCT/US2017/060817
§ 371 (c)(1),
(2) Date: May 17, 2019

(87) PCT Pub. No.: WO2018/111457
PCT Pub. Date: Jun. 21, 2018

(65) Prior Publication Data

US 2019/0323515 A1 Oct. 24, 2019

Related U.S. Application Data

(60) Provisional application No. 62/434,049, filed on Dec. 14, 2016.

(51) Int. Cl.
*F04D 29/16* (2006.01)
*F04D 17/12* (2006.01)
(Continued)

(52) U.S. Cl.
CPC ..... *F04D 29/162* (2013.01); *F04D 17/12* (2013.01); *F04D 29/052* (2013.01); *F04D 29/058* (2013.01)

(58) Field of Classification Search
CPC ..... F04D 29/162; F04D 17/12; F04D 29/052; F04D 29/058
See application file for complete search history.

(56) References Cited

U.S. PATENT DOCUMENTS 4,997,340 A 3/1991 Zinsmeyer et al.
6,273,671 B1 8/2001 Ress, Jr.
(Continued)

FOREIGN PATENT DOCUMENTS

CN 101122294 A 2/2008
CN 101514705 A 8/2009
(Continued)

OTHER PUBLICATIONS

Chinese Office Action dated Apr. 14, 2020 for Chinese Patent Application No. 201780072909.X.
(Continued)

*Primary Examiner* — Thomas Truong
(74) *Attorney, Agent, or Firm* — Bachman & LaPointe, P.C.

(57) ABSTRACT

A compressor (22) comprises: a housing (50); a shaft (70); a plurality of bearings (66, 67, 68, 74, 76) mounting the shaft to the housing for relative rotation about an axis (500); and a motor (52). The motor has: a rotor (64) mounted on the shaft; and a stator (62). A first impeller (54A) is mounted the shaft to a first side of the motor. A second impeller (54B) is mounted the shaft to a second side of the motor. The first impeller is an open impeller and the second impeller is a shrouded impeller.

14 Claims, 3 Drawing Sheets

(51) Int. Cl.
*F04D 29/052* (2006.01)
*F04D 29/058* (2006.01)

(56) References Cited

U.S. PATENT DOCUMENTS

| | | | | |
|---|---|---|---|---|
| 6,390,789 | B1 | 5/2002 | Grob et al. | |
| 6,506,015 | B2 | 1/2003 | Nagata et al. | |
| 7,240,515 | B2 | 7/2007 | Conry | |
| 7,322,207 | B2 | 1/2008 | Kikuchi et al. | |
| 7,856,834 | B2 | 12/2010 | Haley | |
| 7,964,982 | B2 | 6/2011 | Bosen | |
| 8,087,880 | B2 | 1/2012 | Karafillis et al. | |
| 8,814,499 | B2 | 8/2014 | Kim | |
| 2004/0179947 | A1* | 9/2004 | Agrawal | F04D 29/624 417/212 |
| 2010/0247283 | A1 | 9/2010 | Andrew et al. | |
| 2011/0280742 | A1 | 11/2011 | Guenard | |
| 2012/0148391 | A1 | 6/2012 | Ibaraki et al. | |
| 2013/0011245 | A1* | 1/2013 | Wiebe | F04D 29/083 415/173.5 |
| 2013/0022461 | A1 | 1/2013 | Shafer et al. | |
| 2013/0156544 | A1* | 6/2013 | Sishtla | F04D 29/058 415/1 |
| 2014/0216087 | A1 | 8/2014 | Sishtla | |
| 2015/0023785 | A1 | 1/2015 | Stanko et al. | |
| 2017/0022999 | A1* | 1/2017 | Peer | F04D 29/4206 |

FOREIGN PATENT DOCUMENTS

| | | | | |
|---|---|---|---|---|
| CN | 101845972 | A | | 9/2010 |
| CN | 102889244 | A | | 1/2013 |
| CN | 103016364 | A | * | 4/2013 |
| CN | 103016364 | A | | 4/2013 |
| GB | 622394 | | | 5/1949 |
| GB | 2074647 | A | | 11/1981 |
| JP | 05149296 | A | | 6/1993 |
| KR | 100611319 | B1 | | 8/2006 |
| WO | 200131213 | A1 | | 5/2001 |
| WO | 2009056987 | A2 | | 5/2009 |
| WO | 2012145486 | A2 | | 10/2012 |

OTHER PUBLICATIONS

International Search Report and Written Opinion dated Feb. 13, 2018 for PCT/US2017/060817.
Chinese Office Action dated Sep. 9, 2020 for Chinese Patent Application No. 201780072909.X.

* cited by examiner

TWO-STAGE CENTRIFUGAL COMPRESSOR

CROSS-REFERENCE TO RELATED APPLICATION

Benefit is claimed of U.S. Patent Application No. 62/434,049, filed Dec. 14, 2016, and entitled "Two-Stage Centrifugal Compressor", the disclosure of which is incorporated by reference herein in its entirety as if set forth at length.

BACKGROUND

The disclosure relates to compressors. More particularly, the disclosure relates to electric motor-driven magnetic bearing compressors.

One particular use of electric motor-driven compressors is liquid chillers. An exemplary liquid chiller uses a hermetic centrifugal compressor. The exemplary unit comprises a standalone combination of the compressor, the cooler unit, the chiller unit, the expansion device, and various additional components.

Some compressors include a transmission intervening between the motor rotor and the impeller to drive the impeller at a faster speed than the motor. In other compressors, the impeller is directly driven by the rotor (e.g., they are on the same shaft).

Various bearing systems have been used to support compressor shafts. One particular class of compressors uses magnetic bearings (more specifically, electro-magnetic bearings). To provide radial support of a shaft, a pair of radial magnetic bearings may be used. Each of these may be backed up by a mechanical bearing (a so-called "touch-down" bearing). Additionally, one or more other magnetic bearings may be configured to resist loads that draw the shaft upstream (and, also, opposite loads). Upstream movement tightens the clearance between the impeller and its shroud and, thereby, risks damage. Opposite movement opens clearance and reduces efficiency.

Magnetic bearings use position sensors for adjusting the associated magnetic fields to maintain radial and axial positioning against the associated radial and axial static loads of a given operating condition and further control synchronous vibrations. One example is shown in U.S. Patent Application Publication 20140216087A1, of Sishtla, published Aug. 7, 2014, the disclosure of which is incorporated by reference in its entirety herein as if set forth at length.

SUMMARY

One aspect of the disclosure involves a compressor comprising: a housing; a shaft; a plurality of bearings mounting the shaft to the housing for relative rotation about an axis; and a motor. The motor has: a rotor mounted on the shaft; and a stator. A first impeller is mounted the shaft to a first side of the motor. A second impeller is mounted the shaft to a second side of the motor. The first impeller is an open impeller and the second impeller is a shrouded impeller.

In one or more embodiments of any of the foregoing embodiments, the first impeller has an axial inlet and a radial outlet; and the second impeller has an axial inlet and a radial outlet.

In one or more embodiments of any of the foregoing embodiments, the first impeller inlet and the second impeller inlet face outward from the motor in opposite axial directions.

In one or more embodiments of any of the foregoing embodiments, a radial balance piston seal seals the first impeller.

In one or more embodiments of any of the foregoing embodiments, an axial balance piston seal seals the second impeller.

In one or more embodiments of any of the foregoing embodiments, a radial seal seals the second impeller's shroud.

In one or more embodiments of any of the foregoing embodiments, the first impeller is of a stage and the second impeller is of another stage in series with the stage.

In one or more embodiments of any of the foregoing embodiments, the plurality of bearings comprises a magnetic thrust bearing.

In one or more embodiments of any of the foregoing embodiments, the plurality of bearings further comprises a first magnetic radial bearing and a second magnetic radial bearing.

In one or more embodiments of any of the foregoing embodiments, a controller is configured to control the magnetic thrust bearing to vary clearance of the first impeller.

In one or more embodiments of any of the foregoing embodiments, a method for using the compressor comprises controlling the magnetic thrust bearing to vary clearance of the first impeller.

In one or more embodiments of any of the foregoing embodiments, the varying includes reducing the clearance of the first impeller to increase a sealing engagement of a seal of the second impeller.

Another aspect of the disclosure involves a compressor comprising: a housing; a shaft; a plurality of bearings mounting the shaft to the housing for relative rotation about an axis; and a motor. The motor has: a rotor mounted on the shaft; and a stator. A first impeller is mounted the shaft to a first side of the motor. A second impeller is mounted the shaft to a second side of the motor. The first impeller is an open impeller facing in a first direction and the second impeller is an open impeller facing in the first direction.

In one or more embodiments of any of the foregoing embodiments, the first impeller has an axial inlet and a radial outlet; and the second impeller has a radial inlet and a radial outlet.

In one or more embodiments of any of the foregoing embodiments, the first impeller is of a stage; and the second impeller is of another stage in series with the stage.

In one or more embodiments of any of the foregoing embodiments, a first radial seal intervenes between the first impeller and the motor and a second radial seal intervenes between the second impeller and the motor.

In one or more embodiments of any of the foregoing embodiments, a method for using the compressor comprises controlling the magnetic thrust bearing to vary clearance of the first impeller.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
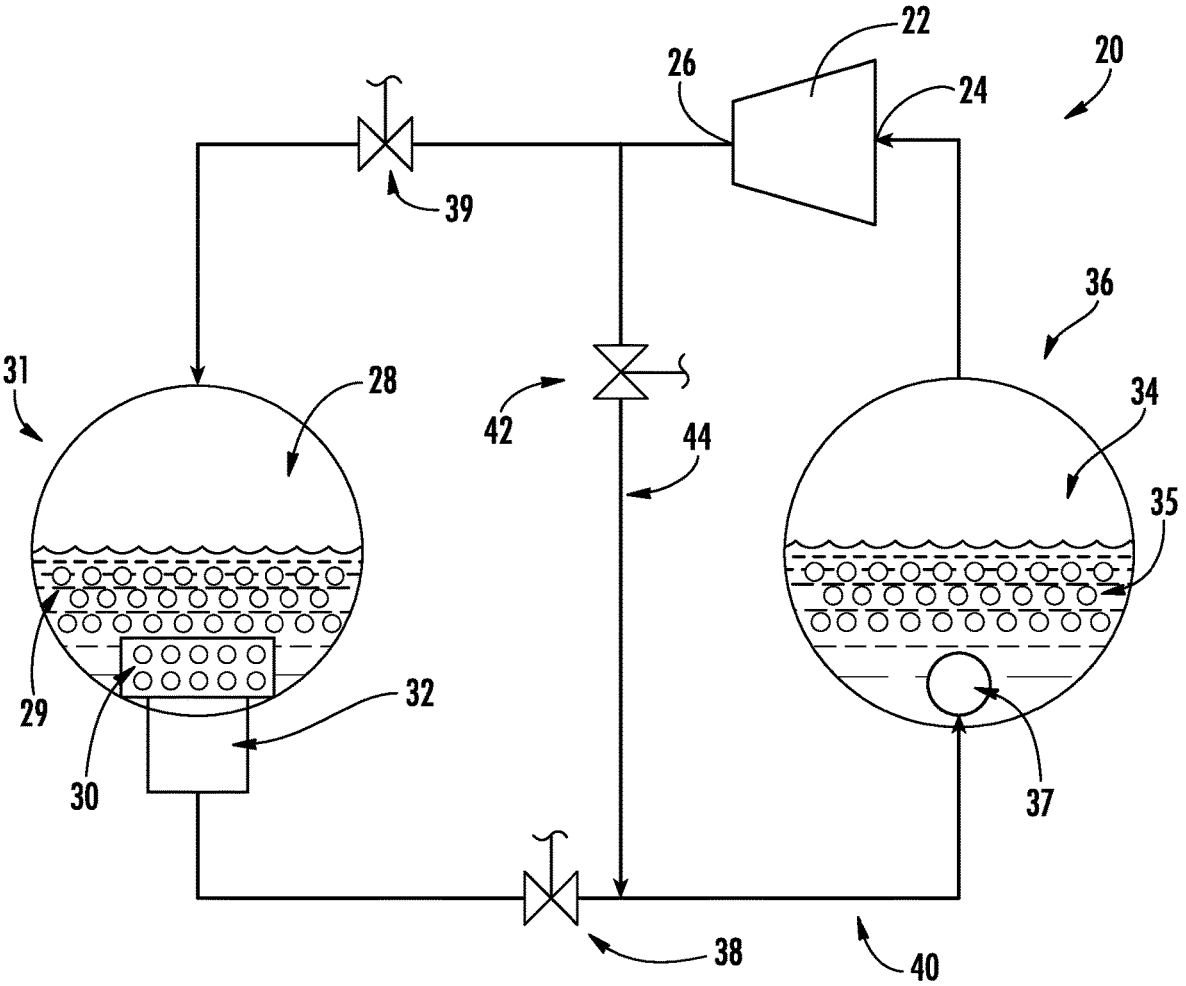
FIG. 1 is a partially schematic view of a chiller system.

FIG. 1 shows a vapor compression system 20. The exemplary vapor compression system 20 is a chiller system. The system 20 includes a centrifugal compressor 22 having a suction port (inlet) 24 and a discharge port (outlet) 26. The system further includes a first heat exchanger 28 in a normal operating mode being a heat rejection heat exchanger (e.g., a gas cooler or condenser). In an exemplary system based upon an existing chiller, the heat exchanger 28 is a refrigerant-water heat exchanger formed by tube bundles 29, 30 in a condenser unit 31 where the refrigerant is cooled by an external water flow. A float valve 32 controls flow through the condenser outlet from a subcooler chamber surrounding the subcooler bundle 30.

The system further includes a second heat exchanger 34 (in the normal mode a heat absorption heat exchanger or evaporator). In the exemplary system, the heat exchanger 34 is a refrigerant-water heat exchanger formed by a tube bundle 35 for chilling a chilled water flow within a chiller unit 36. The unit 36 includes a refrigerant distributor 37. An expansion device 38 is downstream of the condenser and upstream of the evaporator along the normal mode refrigerant flowpath 40 (the flowpath being partially surrounded by associated piping, etc.).

A hot gas bypass valve 42 is positioned along a bypass flowpath branch 44 extending between a first location downstream of the compressor outlet 26 and upstream of an isolation valve 39 and a second location upstream of the inlet of the cooler and downstream of the expansion device 38.

Figure 2:
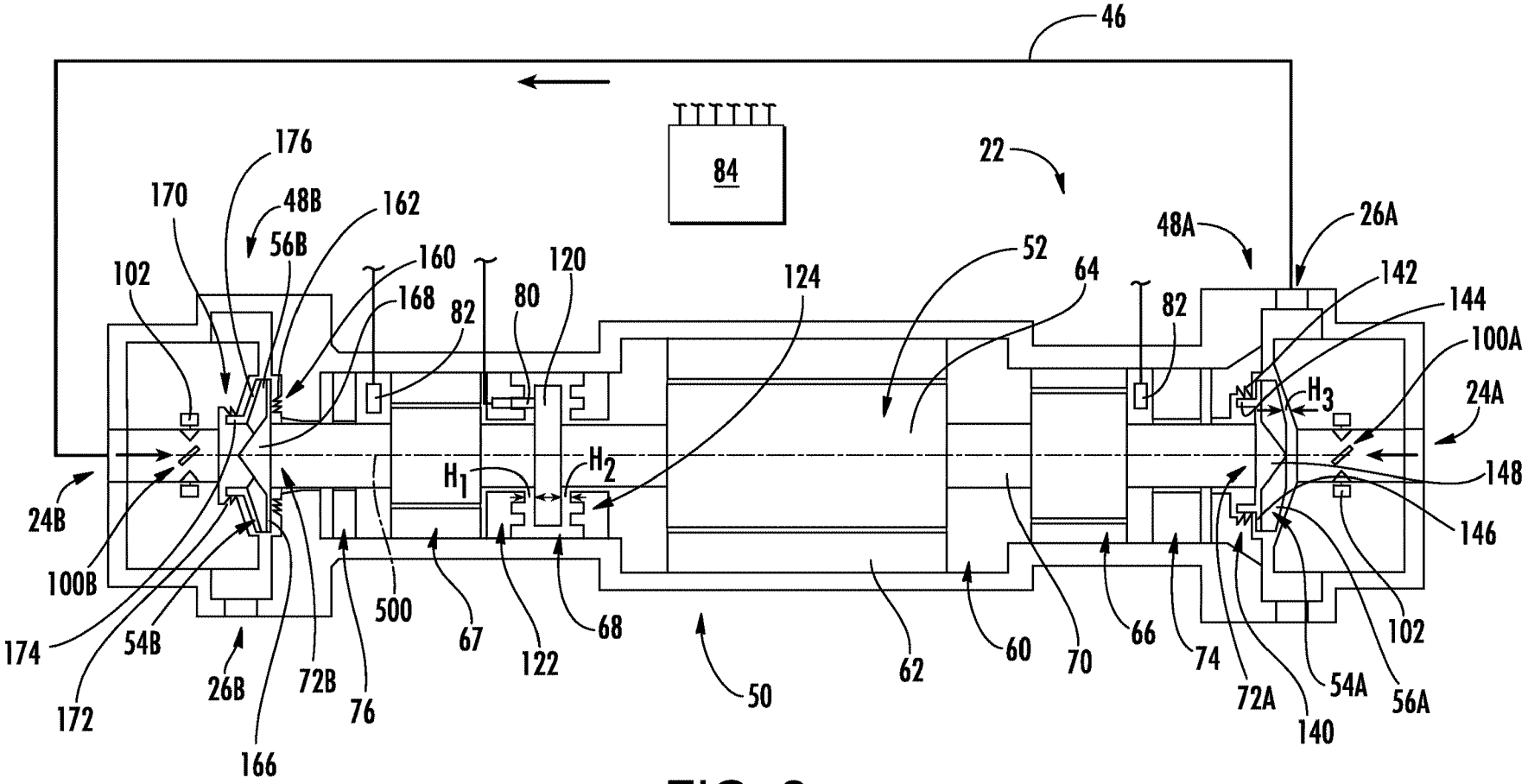
FIG. 2 is a longitudinal sectional view of a compressor of the chiller system.

The compressor 22 (FIG. 2) has a housing assembly (housing) 50. The compressor 22 is a two-stage compressor having two stages 48A and 48B. In various implementations, the stages may have various relationships. FIG. 2 shows an exemplary series relationship wherein each stage has a respective inlet 24A, 24B, and a respective outlet 26A, 26B. In the exemplary series implementation, the outlet 26A is connected to the inlet 24B by an interstage line 46. In this exemplary implementation, the stage 48A is a first stage and the inlet 24A provides the overall compressor inlet 24 of FIG. 1. Similarly, the stage 48B is a second stage with its outlet 26B providing the overall compressor outlet. In various other implementations, the two stages may be in parallel or may be otherwise coupled. For example, in economized situations, an economizer line may join the interstage line 46 so that the discharge flow from the second stage is provided by a combination of the first stage inlet flow and the economizer flow. Yet other configurations are possible.

The exemplary housing assembly contains an electric motor 52 and respective impellers 54A, 54B of the two stages drivable by the electric motor in the first mode to compress fluid (refrigerant) to draw fluid (refrigerant) in through the suction port 24, compress the fluid, and discharge the fluid from the discharge port 26. The exemplary impellers are directly driven by the motor (i.e., without an intervening transmission).

The impellers have respective blades 56A, 56B. As is discussed further below, the exemplary first impeller 54A is an unshrouded or open impeller and the exemplary impeller 54B is a shrouded impeller. In a shrouded impeller, the shroud is integral with the impeller. In an unshrouded or open impeller, the shroud in the portion of the housing assembly that does not rotate with the impeller and has a clearance relative to the impeller (although in an abnormal situation the clearance might go to zero but avoiding such a situation) is desired and, as is discussed below, optimizing the non-zero value of this clearance is a relevant factor in compressor performance.

The housing defines a motor compartment 60 containing a stator 62 of the motor within the compartment. A rotor 64 of the motor is partially within the stator and is mounted for rotation about a rotor axis 500. The exemplary mounting is via one or more electromagnetic bearing systems 66, 67, 68 mounting a shaft 70 of the rotor to the housing assembly. The exemplary impellers 54A and 54B are respectively mounted to the shaft (e.g., to respective end portions 72A and 72B) to rotate therewith as a unit about an axis 500.

Each of the exemplary stages has an inlet guide vane (IGV) array 100A, 100B driven by vane actuator(s) 102 (e.g., a single servomotor coupled via gears or pulleys to all the vanes or separate servomotors driving each vane).

The exemplary bearing system 66 is a radial bearing and mounts an intermediate portion of the shaft (i.e., between the impeller and the motor) to the housing assembly. The exemplary bearing system 67 is also a radial bearing and mounts an opposite portion of the shaft to the housing assembly. The exemplary bearing 68 is a thrust/counterthrust bearing. The radial bearings radially retain the shaft while the thrust/counterthrust bearing has respective portions axially retaining the shaft against thrust and counterthrust displacement. FIG. 2 further shows an axial position sensor 80 and a radial position sensor 82. These may be coupled to a controller 84 which also controls the motor, the powering of the bearings, and other compressor and system component functions. The controller may receive user inputs from an input device (e.g., switches, keyboard, or the like) and additional sensors (not shown). The controller may be coupled to the controllable system components (e.g., valves, the bearings, the compressor motor, vane actuators 102, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The assignment of thrust versus counterthrust directions is somewhat arbitrary. For purposes of description, the counterthrust bearing is identified as resisting the upstream movement of the impeller caused by its cooperation with the fluid. The thrust bearing resists opposite movement. The exemplary thrust/counterthrust bearing is an attractive bearing (working via magnetic attraction rather than magnetic repulsion). The bearing 68 has a thrust collar 120 rigidly mounted to the shaft 72. Mounted to the housing on opposite sides of the thrust collar are a counterthrust coil unit 122 and a thrust coil unit 124 whose electromagnetic forces act on the thrust collar. There are gaps of respective heights $H_1$ and $H_2$ between the coil units 122 and 124 and the thrust collar 120.

FIG. 2 further shows mechanical bearings 74 and 76 respectively serving as radial touchdown bearings so as to provide a mechanical backup to the magnetic radial bearings 66 and 67, respectively. The inner race has a shoulder that acts as an axial touchdown bearing.

Although the exemplary compressor is based on the configuration of the aforementioned U.S. Patent Application Publication No. 2014/0216087A1 with the addition of the second stage, other compressor configurations may serve as a baseline. The sensors 80 and 82 may be existing sensors used for control of the electromagnetic bearings. In an exemplary modification from a baseline such system and compressor, the control routines of the controller 84 may be augmented with an additional routine or module which uses the outputs of one or both of the sensors 80 and 82 to optimize a running clearance (the clearance $H_3$ when the compressor is running). The hardware may otherwise be preserved relative to the baseline.

In centrifugal compressors using open type impellers, running clearance between impeller and shroud is a key characteristic that influences compressor efficiency. Reducing clearance will improve efficiency.

The actual instantaneous clearance $H_3$ (running clearance) may be difficult to directly measure. Measured axial position of the impeller at the bearing system (e.g., at the thrust collar) may act as a proxy for a non-running clearance $H_3$ (cold clearance). The running clearance will reflect cold clearance combined with impeller and/or shaft deformation/deflection (e.g., deformations/deflections due to operational forces) and the like.

In an exemplary baseline compressor, a cold clearance is set during assembly to ensure that adequate running clearance will be provided across the intended range of operation. During assembly, the axial range or movement of the shaft as limited by the touchdown bearing is adjusted (e.g., via rotor shimming) to be within certain range. For example, in an exemplary 500-1000 cooling ton (1750-3500 kW) compressor, an exemplary range is 0.002-0.020 inch (0.05-0.5 mm) (of cold clearance as determined by the mechanical touchdown bearings). The baseline control algorithm seeks to maintain a nominal cold clearance within that range.

As in U.S. Patent Application Publication No. 20140216087A1, it may be desired, however, to vary cold clearance of the impeller 54A during operation. It may be desired to change the cold clearance while the compressor is running to optimize performance (e.g., maximize efficiency) and/or maximize capacity. Having the shrouded impeller at the opposite end allows control of the clearance $H_3$ without adversely effecting performance of the second stage. This would be in contrast to having an open impeller at the second stage wherein (if both are rigidly connected to the shaft) reducing the clearance of the first stage impeller would increase the clearance of the second stage impeller. Alternatively, a more mechanically complex arrangement would be required allowing the impellers to shift axially relative to each other.

Relative to having two shrouded impellers, the exemplary configuration may, in at least some implementations, offer one or more advantages. For example, having an open impeller in the first (lower pressure) stage offers an advantage because of the larger blade height due to higher volumetric flow (relative to the smaller blade height and lower volumetric flow rate of the second (higher pressure) stage. The stresses on the blades and impeller bore/hub will be lower without a shroud, allowing lighter/finer structure for greater efficiency.

The second stage blade height is smaller due to compression in first stage, even after adding economizer flow, hence it can be a shrouded impeller (the relative benefits of weight reduction compared with a shrouded impeller are less for a smaller impeller and thus may not offset the leakage losses).

Where the injection mass flow is higher due to intermediate hot gas injection (not shown in FIG. 1), the second stage would increase in relative size and thus could be an open impeller mounted facing the same direction as the first stage. In case of parallel operation, the open and shrouded position does not matter.

It may be desirable to have a smaller cold clearance at part load than at full load. In such a situation, running clearance may be similar across the load range. If cold clearance were set for adequate running clearance at max load, then there would be relatively large running clearance at part/low load. The clearance is associated with a leakage flow between impeller and shroud which represents a loss. At low load, the larger running clearance causes a disproportionately large loss and therefore efficiency reduction. Reducing cold clearance at low loads to a level that still ensures adequate running clearance can at least partially reduce the relative efficiency loss associated with the leakage.

Controlling rotor position or the associated cold clearance to reduce running clearance also has benefit in increasing the maximum available flow through the compressor. The flow through the compressor is the flow through the impeller minus leakage flow through the clearance (an internal recirculation). The maximum flow through the impeller is related to impeller geometry. Accordingly, reducing running clearance decreases the leakage flow and increases the maximum available flow through the compressor. This effect may increase capacity at a given operational condition (given pressure difference).

The magnetic thrust bearing is designed to carry the axial load within the above range. This is done by varying the magnetic field on either side (a thrust side and a counter-thrust side) of the bearing. Estimated required clearance at various loads is loaded into controls software. The capacity can be determined either from inlet guide vane position or measurement of evaporator water flow rate and state points (pressure and temperature).

Another way of setting the position of impeller dynamically or adaptively is by measuring the power for several positions at a given operating condition and selecting the one that gives the minimum power.

An exemplary magnetic bearing works on the principle of attraction: the higher the field current, the more the attractive force. Thus an attractive magnetic thrust bearing may be located axially opposite a mechanical thrust bearing (e.g. a mechanical bearing serving as a back-up to the magnetic bearing. With attractive bearings and the bearings exerting a net force in a direction away from the suction port, the coil unit 122 may be powered at a higher voltage than the unit 124. The unit 122 is thus designated as the "active side" whereas the opposite unit 124 would be the "inactive side". The impeller is subjected to axial thrust due to gas forces which moves the impeller toward the shroud and closes the gap. By adjusting the current to the thrust side and the counter thrust side, the gap can be adjusted to the required position. Further details of control are given in the aforementioned U.S. Patent Application Publication No. 20140216087A1.

The provision of a shrouded impeller 54B axially opposite the open impeller 54A allows position control to be made based upon desired clearance of the open impeller. In order to accommodate this movement, different arrangements of sealing systems may be applied in the respective stages.

FIG. 2 shows a seal 140 sealing the open impeller 54A. The exemplary seal is a radial seal. The exemplary radial seal involves a sealing member 142 of the housing (e.g., a labyrinth member) engaging a complementary portion of the impeller or shaft (e.g., a collar 144 extending from the back side of a back plate 146 of the impeller extending outward from an impeller hub 148). The exemplary seal 140 is a radial balance piston seal.

The exemplary impeller 54B has two distinct seals 160 and 170. The exemplary seal 160 comprises a sealing member 162 interfacing with a complementary portion of the impeller 54B or shaft. In the exemplary implementation. The exemplary seal 160 is an axial seal (e.g., an axial balance piston seal) with the member 162 being a labyrinth member interfacing with the backside of the back plate 166 extending outward from the hub 168. The exemplary seal 170 is a radial seal (e.g., radial eye seal) with a seal member 172 which may be otherwise similar to the seal member 142. The exemplary seal member 170 interfaces with the outer diameter surface of a forward collar portion 174 of the shroud 176.

The particular combination of seals may have one or more of several advantages. Seal 140 is a radial seal in order to accommodate the axial shifts of the rotor. The diameter at the inner diameter of the seal (outer diameter of the collar 144) is chosen in the initial engineering process to provide a desired net thrust force at an operating condition. If the motor compartment is at a low pressure (e.g., about suction pressure), then a larger diameter means more of the impeller backside is at low pressure. Decreasing diameter increases the amount of the backside exposed to the impeller outlet pressure and thus adds bias away from the motor (reduces bias toward the motor). A typical axial seal would lack the ability to accommodate axial displacements.

Seal 170 is positioned at the impeller inlet which is referred to as the "eye" of the impeller. One can use either a radial or axial at the eye. However, an axial seal will tend to disengage and create/increase a local seal clearance when the shaft is moved to shift the open impeller to reduce the clearance $H_3$. The eye is may be set at an exemplary 0.25 to 0.5 inch (6.4 mm to 12.7 mm) above (radially outboard of) the inlet blade to reduce stresses and minimize leakage flow. Having a smaller seal diameter means a smaller potential leakage area. However, the shroud should be thick enough to provide desired strength (and thickness may be influenced by selected manufacturing process). The exemplary seal 160 is an axial seal. One possible benefit of an axial seal 160 is seen in that seal 160 will likely be subject to the highest pressure difference of any seal in the system. In general, the rotor may be shifted to reduce $H_3$ at higher speeds and higher operating pressures (overall pressure differences and thus higher differences across the seal 160). This shift thus reduces the clearance of the seal 160 and improves sealing when improved sealing is most needed.

Operationally, the impeller 54B may be subject to a greater range of motion than is the impeller 54A. This is because differential thermal expansion or mechanical loading factors may cause relative expansion or contraction between the housing and the shaft which may, depending upon circumstances, either add to or subtract from the axial spacing of the two impellers. The second stage has higher temperature and pressure than the first stage. Hence, it can see higher range of motion than the first one.

FIG. 1 further shows the controller 84. The controller may receive user inputs from an input device (e.g., switches, keyboard, or the like) and sensors (not shown, e.g., pressure sensors and temperature sensors at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The compressor and system may be made using otherwise conventional or yet-developed materials and techniques.

Figure 3:
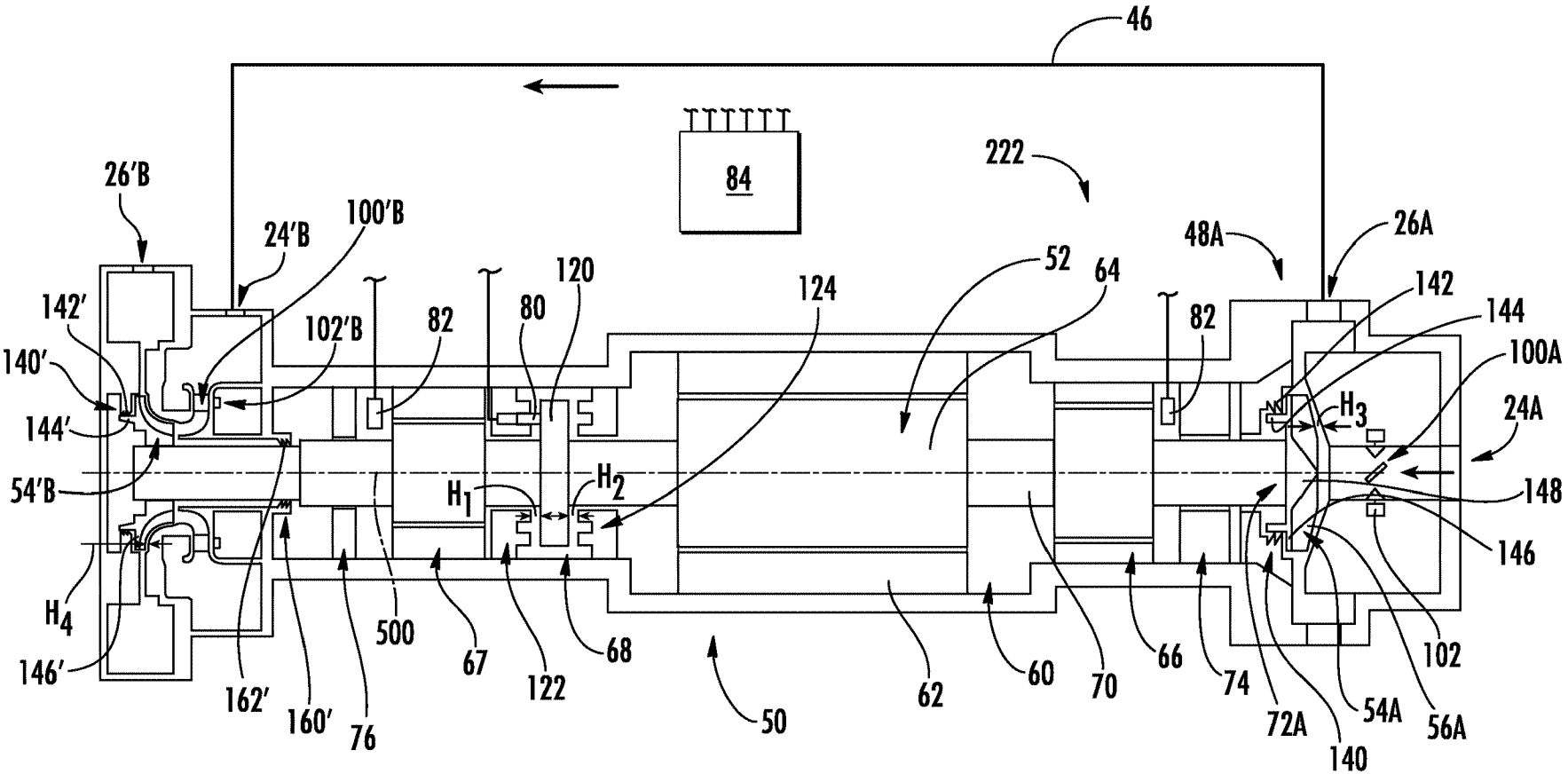
FIG. 3 is a longitudinal sectional view of a second compressor

FIG. 3 shows a compressor 222 which, except as described below, may be similar to the compressor 22 and which is, thus, labeled with many of the same reference numerals. The main difference is that the second stage impeller 54'B is an open impeller having a clearance $H_4$ relative to the adjacent fixed shroud. The impeller 34'B faces in the same direction as the impeller 54A. Thus, rotor movement by the axial bearing 68 will tend to increase or decrease $H_4$ and $H_3$ together. The second stage has an inlet port 24'B and an outlet port 26'B. Inlet port is to an annular inlet plenum. A radial inlet guide vane array 100'B is shown with actuator(s) 102'. For seals, the second stage has a radial seals 140' and 160'. The exemplary radial seal 140' has a sealing member 142' of the housing (e.g., a labyrinth member) engaging a complementary portion of the impeller or shaft (e.g., a collar 144' extending from the back side of a back plate 146' of the impeller or from the impeller hub.) Similarly, the exemplary radial seal 160' has a sealing member 162' of the housing (e.g., a labyrinth member) engaging a complementary portion of the impeller or shaft (e.g., the outer diameter surface of the shaft between the second stage impeller and the motor). The pressure difference across the seal 160' is between the second stage impeller inlet condition (not outlet condition) and the motor housing/case condition. This will be significantly lower than the pressure difference across the FIG. 2 seal 160, all other things being even nearly equal. Thus, it makes sense to have the seal 160' as a radial seal because there is less benefit to having sealing engagement increase with decrease in $H_3$. The radial seal may offer sealing more independent of rotor position and with less wear.

Where a labyrinth or other seal member is shown on one component (e.g., a non-rotating component, and its mating/sealing member is on another component (e.g., a rotating component), an alternative would involve reversal (i.e. placing the labyrinth or other sealing member on the rotating component).

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A compressor (22) comprising:

a housing (50);

a shaft (70);

a plurality of bearings (66, 67, 68, 74, 76) mounting the shaft to the housing for relative rotation about an axis (500);

a motor (52), having:

a rotor (64) mounted on the shaft; and a stator (62);

a first impeller (54A) mounted the shaft to a first side of the motor; and a second impeller (54B) mounted the shaft to a second side of the motor, wherein:

the first impeller is an open impeller;

the second impeller is a shrouded impeller; and the plurality of bearings comprises a magnetic thrust bearing (68).

2. The compressor of claim 1 wherein:

the first impeller has an axial inlet and a radial outlet; and the second impeller has an axial inlet and a radial outlet.

3. The compressor of claim 2 wherein:

the first impeller inlet and the second impeller inlet face outward from the motor in opposite axial directions.

4. The compressor of claim 1 further comprising:

a radial balance piston seal (140) sealing the first impeller.

5. The compressor of claim 1 further comprising:

an axial balance piston seal (160) sealing the second impeller.

6. The compressor of claim 1 further comprising:

a radial seal (170) sealing the second impeller's shroud.

7. The compressor of claim 1 wherein:

the first impeller is of a stage; and the second impeller is of another stage in series with the stage.

8. The compressor of claim 1 wherein:

the first impeller is a lower pressure impeller and the second impeller is a higher pressure impeller so that a flowpath from a compressor inlet to a compressor outlet proceeds sequentially through the first impeller and then the second impeller.

9. The compressor of claim 8 wherein:

the first impeller has a greater blade height than does the second impeller.

10. The compressor of claim 1 wherein:

the plurality of bearings further comprises a first magnetic radial bearing (66) and a second magnetic radial bearing (67).

11. The compressor of claim 1 further comprising:

a controller configured to control the magnetic thrust bearing to vary clearance of the first impeller.

12. The compressor of claim 1 wherein:

the first impeller has a greater blade height than does the second impeller.

13. A method for using the compressor of claim 1, the method comprising:

controlling the magnetic thrust bearing to vary clearance of the first impeller.

14. The method of claim 13 wherein:

the varying includes reducing the clearance of the first impeller to increase a sealing engagement of a seal of the second impeller.

* * * * *